US005515915A

United States Patent [19]

Jones et al.

[11] Patent Number: 5,515,915

[45] Date of Patent: May 14, 1996

[54] WELL SCREEN HAVING INTERNAL SHUNT TUBES

[75] Inventors: Lloyd G. Jones, Dallas; Tommy J. Yates, Coppell, both of Tex.

[73] Assignee: Mobil Oil Corporation, Fairfax, Va.

[21] Appl. No.: 419,169

[22] Filed: Apr. 10, 1995

[51] Int. Cl.[6] ..... E21B 43/08

[52] U.S. Cl. ..... 166/51; 166/227

[58] Field of Search ..... 166/227, 231, 166/233, 235, 51, 278

[56] References Cited

U.S. PATENT DOCUMENTS

| | | | |
|---|---|---|---|
| 1,473,644 | 11/1923 | Rodrigo, Sr. | 116/235 |
| 4,428,428 | 1/1984 | Smyrl et al. | 166/51 |
| 4,945,991 | 8/1990 | Jones . | |
| 4,977,958 | 12/1990 | Miller | 166/51 X |
| 5,004,049 | 4/1991 | Arterbury | 166/233 X |
| 5,082,052 | 1/1992 | Jones et al. . | |
| 5,113,935 | 5/1992 | Jones et al. . | |
| 5,115,864 | 5/1992 | Gaidry et al. | 166/278 |
| 5,161,613 | 11/1992 | Jones . | |
| 5,161,618 | 11/1992 | Jones et al. . | |
| 5,332,045 | 7/1994 | Ross et al. | 166/387 |
| 5,333,688 | 8/1994 | Jones et al. . | |
| 5,341,880 | 8/1994 | Thorstensen et al. | 166/51 X |
| 5,355,949 | 10/1994 | Sparlin et al. | 166/236 |
| 5,392,850 | 2/1995 | Cornette et al. | 166/51 |
| 5,419,394 | 5/1995 | Jones | 166/233 X |

FOREIGN PATENT DOCUMENTS

0622523A2 11/1994 European Pat. Off. .

OTHER PUBLICATIONS

Brochures: Gravel Pack Screens (a) Baker Sand Control; (b) Howard Smith Screen Co. (c) UOP, Inc. Johnson Div.

"Alternate Path Gravel Packing"; L. G. Jones et al SPE22796, presented 66th Annual SPE Conference in Dallas, TX on Oct. 6–9, 1991.

*Primary Examiner*—Frank S. Tsay

*Attorney, Agent, or Firm*—Alexander J. McKillop; George W. Hager, Jr.; Lawrence O. Miller

[57] ABSTRACT

A well screen for use in gravel packing completions which produces a good distribution of gravel over the entire completion interval. The screen is comprised of a base pipe and an outer surface (e.g. wire wrap). A plurality of flow paths (e.g. shunt tubes) are positioned in the annulus which is formed between the base pipe and the outer surface of the screen, thereby providing the necessary alternate flowpaths for the slurry without substantially increasing the overall, effective outside diameter of the screen.

14 Claims, 2 Drawing Sheets

WELL SCREEN HAVING INTERNAL SHUNT TUBES

DESCRIPTION

1. Technical Field

The present invention relates to a well screen for use in a wellbore and in one of its aspects relates to a well screen for gravel pack well completion which includes a plurality of shunt tubes (i.e. alternate flowpaths) axially extending along and positioned inside the screen for delivering a gravel slurry to different levels within the wellbore annulus during a gravel-pack completion operation.

2. Background

In producing hydrocarbons or the like from loosely or unconsolidated and/or fractured subterranean formations, it is not uncommon to produce large volumes of particulate material (e.g. sand) along with the formation fluids. As is known in the art, these particulates routinely cause a variety of problems which result in added expense and substantial downtime. Accordingly, it is extremely important to control the production of particulates in most operations.

Probably the most popular technique used for controlling the production of particulates (e.g. sand) from a well is one which is known as "gravel packing". In a typical gravel pack completion, a well screen is lowered into the wellbore and positioned adjacent the interval of the well which is to be completed. Particulate material, collectively referred to as gravel, is then pumped as a slurry down the tubing on which the screen is suspended. The slurry exits the tubing above the screen through a "cross-over" or the like and flows downward in the annulus formed between the screen and the well casing or open hole, as the case may be.

The liquid in the slurry flows into the formation and/or the openings in the screen which are sized to prevent the gravel from flowing therethrough. This results in the gravel being deposited or "screened out" in the annulus around the screen where it collects to form the gravel pack. The gravel is sized so that it forms a permeable mass therethrough and into the screen while blocking the flow of any particulates produced with the formation fluids.

One of the major problems associated with gravel packing, especially where long or inclined intervals are to be completed, is obtaining proper distribution of the gravel over the entire interval to be completed, i.e. completely packing the annulus between the screen and the casing in cased wells or between the screen and the wellbore in open hole or under-reamed completions. Poor distribution of gravel (i.e. incomplete packing of the interval resulting in voids in the gravel pack) is often caused by the loss of liquid from the gravel slurry into the more permeable portions of the formation interval which, in turn, causes the formation of gravel (e.g. sand) "bridges" in the annulus before all of the gravel has been placed. These bridges block further flow of the slurry through the annulus thereby preventing the placement of sufficient gravel (a) below the bridge for top-to-bottom packing operations or (b) above the bridge, for bottom-to-top packing operations.

Both U.S. Pat. No. 4,945,991 and SPE paper 22796, "ALTERNATE PATH GRAVEL PACKING", L. G. Jones et al, SPE Dallas, Tex., Oct. 6–9, 1991 describe a gravel packing method and apparatus which provides a good distribution of gravel throughout the desired interval of the wellbore even when sand bridges form before all the gravel is deposited. In this method, perforated shunts (i.e. flow conduits) extend along the length of the screen and are in fluid communication with the gravel slurry as it enters the annulus in the wellbore adjacent the screen.

If a sand bridge forms before all of the gravel is placed, the slurry will flow through the conduits past the sand bridges and out into the annulus through the perforations spaced along the conduits to complete the filling of the annulus above and/or below the bridge. See also, U.S. Pat. No. 5,113,935 for a further modification of this type of well screen. In some instances, valve-like devices are provided for the perforations in these conduits so that there is no flow of slurry through the conduits until a bridge is actually formed in the annulus; see U.S. Pat. No. 5,082,052.

In these prior art gravel-pace screens, the individual conduits or shunts are shown as being preferably carried externally on the outside surface of the screen. While this positioning of the shunt tubes works well in a large number of applications, unfortunately, these externally-mounted shunts are not only exposed to possible damage during installation but, more importantly, effectively increase the overall diameter of the screen. The latter is extremely important when the screen is to be run into a small diameter wellbore where even fractions of an inch in the effective diameter of the screen may be vital in successfully gravel-packing a well.

Other downhole well tools have been proposed for fracturing a formation (U.S. Pat. No. 5,161,618) or treating a formation (U.S. Pat. No. 5,161,613) wherein individual conduits or shunts are positioned internally within a housing or the like to deliver a particular treating or fracturing fluid to selective levels within the wellbore. However, the outlets through the housing of these tools remain open after the particular operation is completed which would be detrimental in gravel packing completions since the produced fluids could then carry particulates back into the housing through these openings after the gravel-pack has been completed and the well has been put on production.

U.S. Pat. No. 5,333,688 discloses a gravel-pack screen having shunts positioned within the base pipe of the screen where they do not increase the overall diameter of the screen. Gravel slurry carried by these shunt tubes is delivered to different levels in the well annulus around the screen through spaced outlets through the housing. However, by placing the shunts within the base pipe (i.e. ultimately part of the production flowpath), an intricate and sophisticated valve is required to close each of the outlets after the gravel packing operation is completed, thereby adding substantially to the costs of the screen and of installation.

SUMMARY OF THE INVENTION

The present invention provides a well screen which is to be used in gravel packing completion in a wellbore wherein a good distribution of gravel is obtained over the entire completion interval even if a sand bridge or the like is formed in the well annulus before the placement of the gravel is completed. Basically, the present invention provides for distributing the gravel slurry to different points of the wellbore annulus from a plurality of flow conduits or shunt tubes which are positioned within the annulus which is formed between the base pipe and the outer surface of the screen, thereby providing the necessary alternate flowpaths for the slurry without substantially increasing the overall, outside diameter of the screen.

More specifically, the well screen of the present invention is comprised of a base pipe which has a plurality of openings through the wall thereof and an outer surface which is spaced from the base pipe to form an annulus between the base pipe and the outer surface. At least one, preferably a plurality, of alternate flow paths (e.g. shunt tubes) are spaced radially around the base pipe within the annulus and extend axially along substantially the length of the base pipe. In some instances, solid support members may be interspersed between the shunt tubes to aid in supporting and spacing the outer surface away from the base pipe.

The outer surface of the screen is comprised of a continuous length of a wrap wire which is wrapped around the radially-spaced shunt tubes and the support members, if the latter are present, and is welded at each point at which it contacts the tubes and the support members. Each coil of the wrap wire is slightly spaced from the adjacent coils to thereby form fluid passageways between the respective coils of wire. Preferably, the screen is "prepacked" with a particulate material, e.g. gravel, as is common in the art. A plurality of spaced outlets (e.g. a small hole through the outer surface and into a shunt tube ) are provided along the length of each shunt tube. The present well screen may consist of only one section or it may consist of a plurality of sections which are connected together by subs or blanks.

In a typical gravel pack operation, the present screen is lowered into a wellbore and a gravel slurry is pumped down through a cross-over into the well annulus surrounding the screen. The upper end of each of the shunt tubes within the screen may be open to the annulus to receive the gravel slurry or the tubes may be manifolded together to receive slurry directly from the crossover.

As the gravel slurry flows downward in the well annulus around the screen, it is likely to lose liquid as gravel is deposited around the screen to form the gravel pack. If enough liquid is lost from the slurry before the annulus is filled, a sand bridge is likely to form which will block further flow through well annulus. The shunt tubes in the present well screen allow the slurry to by-pass the bridge in the well annulus and thereby complete the gravel pack.

BRIEF DESCRIPTION OF THE DRAWINGS

The actual construction, operation, and apparent advantages of the present invention will be better understood by referring to the drawings which are not necessarily to scale and in which like numerals identify like parts and in which.

FIG. I is an elevational view, partly in section, of the well screen of the present invention in an operable position within a wellbore.

BEST KNOWN MODE FOR CARRYING OUT THE INVENTION

Figure 1:
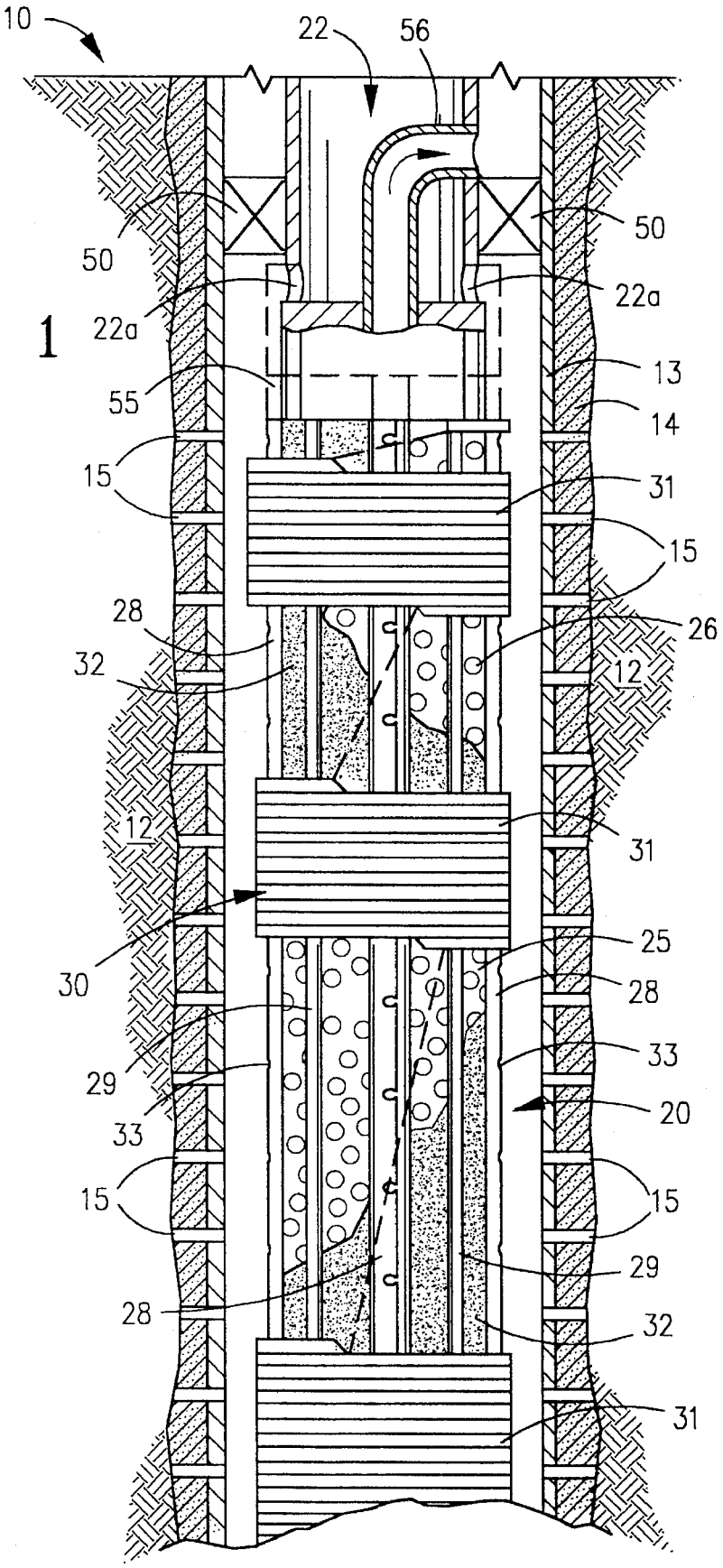

Referring more particularly to the drawings, FIG. 1 illustrates the well screen 20 of the present invention when in an operable position within the lower end of a producing and/or injection well 10. Well 10 has a wellbore 11 which extends from the surface (not shown) through an unconsolidated and/or fractured production and/or injection formation 12. While well 10 is illustrated as a substantially vertical, cased well, it should be recognized that the present invention is equally applicable for use in open-hole wells and/or under-reamed completions as well as in horizontal and/or inclined wellbores.

As shown, wellbore 11 is cased with casing 13 and cement 14 with perforations 15 adjacent the interval of formation 12 which is to be gravel-packed. Screen 20 is connected to the lower end of a cross-over sub 22 which, in turn, is suspended from the surface on a tubing or workstring (not shown) and is positioned adjacent interval 12 to form an annulus 19 with wellbore 11.

Figure 2:
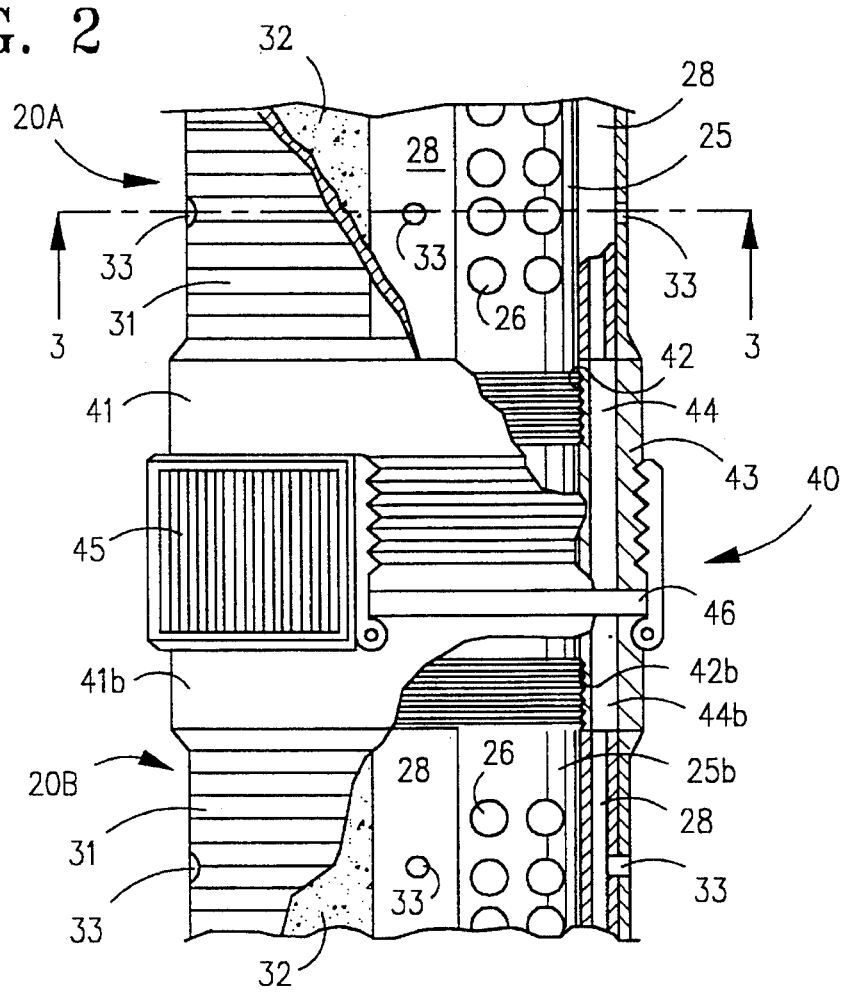
FIG. 2 is an enlarged sectional view, partly cut away, of the coupled end portions of two adjacent sections of the well screen of FIG. 1.
Figure 3:
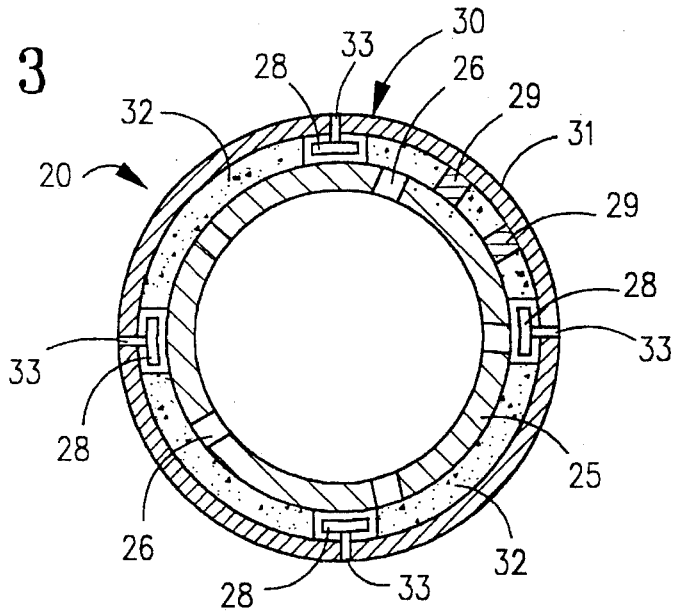
FIG. 3 is a cross-sectional view taken along line 3—3 of FIG. 2.

As illustrated in FIGS. 1–3, screen 20 is comprised of a perforated base pipe 25. While base pipe 25 is shown as having a plurality of perforations 26, it should be recognized that other types of base pipes, e.g. slotted pipe, etc., can be used in place of the perforated pipe without departing from the present invention. One or more shunt tubes 28 (four shown) are space radially around base pipe 25 and extend longitudinally along substantially the length of the base pipe. Shunt tubes (i.e. flow conduits) 28 are shown as being of rectangular cross-section but it should be understood that conduits having other cross-sections (e.g. circular) can be used without departing from the present invention.

As shown, outer surface 30 of screen 20 is comprised of a continuous length of a wrap wire 31 which, in turn, may be cut to provide a "keystone" cross-section (not shown). While only shunt tubes 28 may be used as spacers between base pipe 25 and wire 31, solid support rods or rod wire 29 (only two shown) or the like—which are normally used in prior art screens of this general type—may be interspersed with and/or between shunt tubes 25 to aid in supporting and spacing outer surface 30 (e.g. wire 31) of screen 20 away from base pipe 28.

Wire 31 is wrapped around the radially-spaced shunt tubes 28 and the support wire rods 29, if the latter are present, and is usually welded at each point of contact with the tubes and wire rods. Each coil of the wrap wire is slightly spaced form the adjacent coils to thereby from fluid passageways (not shown) between the respective coils of wire. This is basically the same technique as is commonly used in the manufacture of wire-wrap screen which are presently commerically available, e.g. BAKERWELD Gravel Pack Screens, Baker Sand Control, Houston, Tex.

While not necessary in every case, it is preferred to "prepack" screen 20 with a particulate material, e.g. gravel 32, as is commonly done in the industry. Typically, the gravel is coated with a resin and is placed between the base pipe 25 and outer surface 30 (fills in between shunt tubes 28 and wire rods 29, if present) and is then baked to set the resin to thereby form a solidified pack which is permeable to fluids but impermeable to solids.

A plurality of spaced outlets 33 are provided along the length of each shunt tube 28. For example, after wire 31 has been wrapped and welded to tubes 28 and supports 29 (if present), a small hole can be drilled through the wire and into tube 28 at each location at which an outlet is to be provided.

While screen 20 has been described as being constructed of a perforated base pipe onto which a wire or the like is wrapped in closely-spaced coils to form a permeable liner, it will be recognized by those skilled in the art that outer surface 30 may be formed from a slotted pipe, screen material, or the like, as long as it is permeable to fluids and impermeable to particulates. Accordingly, the "screen" as used throughout the present specification and claims is meant to be generic and to include and cover all types of those structures commonly used by the industry in gravel pack operations which permit flow of fluids therethrough while blocking the flow of particulates (e.g. commerciallyavailable screens, slotted or perforated liners or pipes, screened pipes, prepacked or dual prepacked screens and/or liners, or combinations thereof) into which shunt tubes can be incorporated inside the outer surface of the screen as disclosed in the present invention.

Further, screen 20 may consist of only one section or it may consist of a plurality of sections (e.g. 30 foot section) connected together by subs or blanks. For example, FIG. 2 illustrates a coupling 40 for joining two screen sections 20A, 20B together. Coupling 40 is comprised of annular member 41 which is connected to the lower end of section 20A and has external threads 43 and internal threads 42, the latter being threaded to base pipe 25. Member 41 has a plurality of passages 44 (only one shown) which are aligned with shunt tubes 28 to form an extension of the flowpaths provided by the shunt tubes.

A union joint 45 is connected to the upper end of section 20B and is comprised of annular member 41*b* which has internal threads 42*b* into which base pipe 25*b* is threaded. Member 41*b* has a plurality of passages 44*b* which align with passages 44 in member 41 when sections 20A and 20B are connected together. Threaded sleeve 45 is rotatably mounted on flange 46 and is threaded onto external threads on member 41 to secure the two sections of screen together.

In a typical gravel pack operation, screen 20 is lowered into wellbore 11 (FIG. 1) on a workstring and is positioned adjacent formation 12. Packer 50 is set as will be understood by those skilled in the art. Gravel slurry is then pumped down the workstring, into cross-over 22 and out of outlet ports 22*a* into annulus 19 of the wellbore. The upper end of each shunt tubes 28 may be open to the annulus 19 to receive the gravel slurry or, as shown by the dotted lines in FIG. 1, all of the shunt tubes can be manifolded together by manifold 55 which, in turn, is directly connected to outlet ports 22*a* in cross-over sub 22 whereby the gravel slurry flows directly to shunt tubes 20 from the manifold 55.

As the gravel slurry flows downward in annulus 19 around the screen 20, it is likely to lose liquid to formation 12 and/or through the screen, itself. The liquid entering screen 20 can be returned to the surface through pipe 56 in cross-over 22. The gravel carried in the slurry is deposited and collects in the annulus to form the gravel pack. As is known in the art (see U.S. Pat. No. 4,945,991), if enough liquid is lost from the slurry before the annulus is filled, a sand bridge (not shown) is likely to form which will block flow through annulus 19 and prevent further filling below the bridge. If this occurs while using the present invention, the gravel slurry can continue to flow downward through shunt tubes 28 and out respective outlets 33 therein to by-pass the bridge and complete the gravel pack.

What is claimed is:

1. A well screen comprising:

an outer surface which is permeable to fluids and impermeable to particulate material;

at least one flow path extending axially along and positioned inside in contact with said outer surface of said screen, said outer surface comprising a wire wrapped around said at least one flow path wherein each coil of said wire is spaced from the adjacent coils to thereby provide fluid passages between said coils of wire; and a plurality of outlets for communicating said at least one flow path with the outside of said outer surface of said screen.

2. The well screen of claim 1 wherein said at least one flow path comprises:

a plurality of radially-spaced tubes which extend along and in contact with the inside of said outer surface of said screen.

3. The well screen of claim 2 wherein each of said tubes has a plurality of said outlets axially-spaced along the length of said tube.

4. The well screen of claim 2 including:

at least one support member axially extending along and positioned inside of and in contact with said outer surface of said screen, said at least support member being radially-spaced from said each of said tubes.

5. A well screen comprising:

a base pipe having openings through the wall thereof;

an outer surface which is permeable to fluids and impermeable to particulate material, said outer surface being spaced from said base pipe to thereby form an annulus between said base pipe and said outer surface;

at least one conduit positioned within said annulus and extending axially along said base pipe, said outer surface comprising a wire wrapped around said at least one conduit wherein each coil of said wire is spaced from the adjacent coils to thereby provide fluid passages between said coils of wire; and a plurality of outlets for communicating said at least one conduit with the outside of said outer surface of said screen.

6. The well screen of claim 5 wherein said at least one flow path comprises:

a plurality of tubes radially-spaced around said base pipe within said annulus and extending along said base pipe.

7. The well screen of claim 6 including:

particulate material filling said annulus around said plurality of said tubes.

8. The well screen of claim 5 wherein said plurality of said outlets are axially-spaced along the length of said at least one conduit and wherein each of said openings comprises:

an opening which extends through said outer surface of said screen and into said at least one conduit.

9. The well screen of claim 8 including:

at least one support member positioned within said annulus and extending axially along said base pipe.

10. A well screen comprising:

a plurality of sections, each of said sections comprising:

a base pipe having openings through the wall thereof;

an outer surface which is permeable to fluids and impermeable to particulate material, said outer surface being spaced from said base pipe to thereby form an annulus between said base pipe and said outer surface;

at least one conduit positioned within said annulus and extending axially along said base pipe, said outer surface comprising a wire wrapped around said at least one conduit wherein each coil of said wire is spaced from the adjacent coils to thereby provide fluid passages between said coils of wire;

a plurality of outlets for communicating said at least one conduit with the outside of said outer surface of said screen; and means for coupling said sections together whereby said at least one conduit in one of said sections is in fluid communication with said at least one conduit in an adjacent said section.

11. The well screen of claim 10 wherein said at least one conduit comprises:

a plurality of tubes radially-spaced around said base pipe within said annulus and extending along said base pipe.

12. The well screen of claim 11 including:

particulate material filling said annulus around said plurality of said tubes.

13. The well screen of claim 10 wherein said plurality of said outlets are axially-spaced along the length of said at least one conduit and wherein each of said openings comprises:

an opening which extends through said outer surface of said screen and into said at least one conduit.

14. The well screen of claim 13 including:

at least one support members positioned within said annulus and extending axially along said base pipe.

* * * * *